M7219 XR 4,105,071

United States Patent [19]

Nicolas et al.

[11] 4,105,071

[45] Aug. 8, 1978

[54] METHODS AND APPARATUS FOR DETERMINING THE STUCK POINT OF A CONDUIT IN A BOREHOLE

[75] Inventors: Yves Nicolas, Versailles; André Landaud, Maisons Alfort, both of France

[73] Assignee: Schlumberger Technology Corporation, New York, N.Y.

[21] Appl. No.: 834,196

[22] Filed: Sep. 19, 1977

[51] Int. Cl.[2] ..... E21B 47/00

[52] U.S. Cl. ..... 166/250; 166/65 R; 73/151

[58] Field of Search ..... 166/301, 250, 255, 299, 166/297, 315, 55, 64, 65 R, 66, 98, 214; 73/151

[56] References Cited

U.S. PATENT DOCUMENTS

| | | | |
|---|---|---|---|
| Re. 26,458 | 9/1968 | Moore | 166/250 X |
| 2,629,445 | 2/1953 | Dill | 166/250 |
| 3,006,186 | 10/1961 | Berry | 73/151 |
| 3,227,214 | 1/1966 | Whann | 166/301 X |
| 3,367,179 | 2/1968 | Moore | 73/151 |
| 3,491,830 | 1/1970 | Sweetman | 166/301 X |
| 3,555,896 | 1/1971 | Roberts | 73/151 |
| 3,670,566 | 6/1972 | Basham et al. | 73/151 |
| 3,686,943 | 8/1972 | Smith | 73/151 |

*Primary Examiner*—Stephen J. Novosad
*Attorney, Agent, or Firm*—Ernest R. Archambeau, Jr.; William R. Sherman; Edward M. Roney

[57] ABSTRACT

In the representative embodiment of the new and improved apparatus disclosed herein, a so-called "stuck-point indicator" or "freepoint-indicator" tool includes a unique deformation-responsive sensor tandemly arranged between upper and lower hydraulically-operated tool anchors which, in the preferred embodiment of the tool, are cooperatively arranged to be sequentially engaged with longitudinally-spaced wall portions of a string of well pipe believed to be stuck in a well bore. In the disclosed embodiment of the tool, the new and improved sensor is arranged as an elongated body tandemly interconnecting the tool anchors and having upper and lower portions thereof cooperatively arranged for being preferentially deformed in response to tensional forces and torsional forces acting on the body. Separate strain gages are arranged on the upper and lower portions of the sensor body as required for producing distinctive electrical signals respectively representative of tensional forces and torsional forces acting on the body.

12 Claims, 8 Drawing Figures

FIG. 3
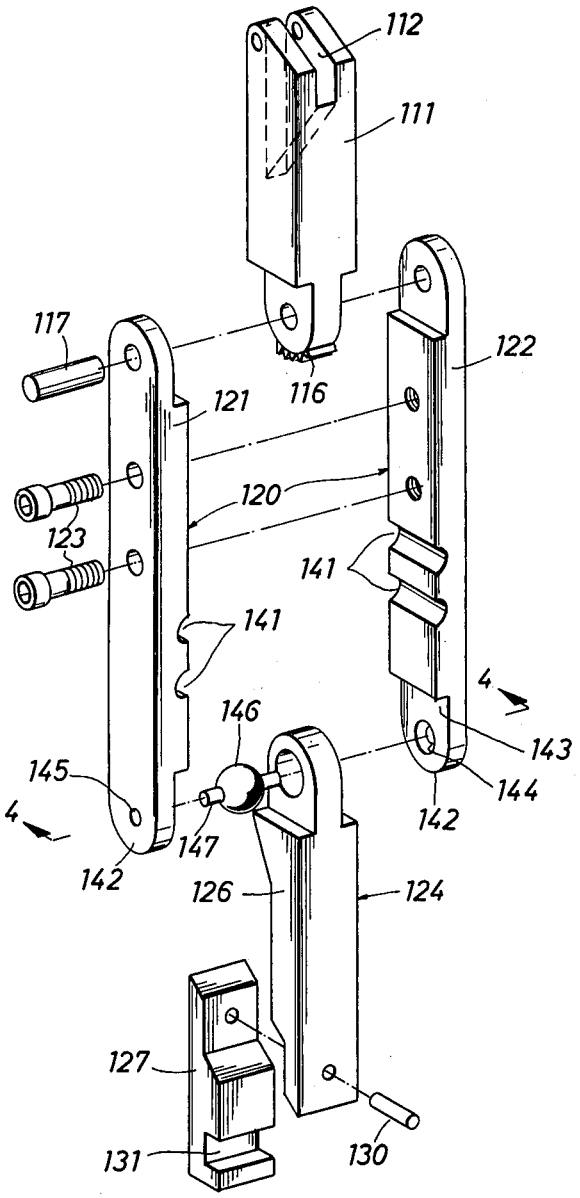
FIG. 5
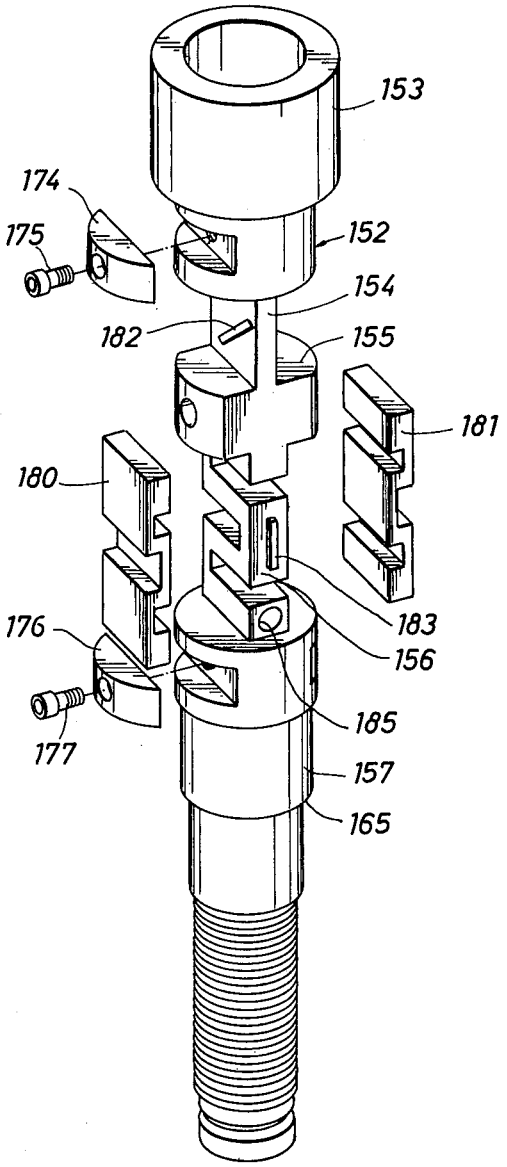
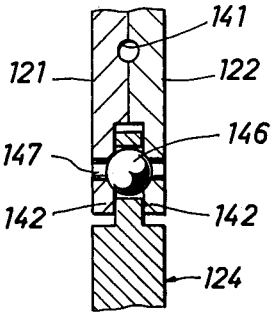
FIG. 4

METHODS AND APPARATUS FOR DETERMINING THE STUCK POINT OF A CONDUIT IN A BOREHOLE

When a string of pipe becomes stuck at some unknown depth location in a well bore, it is, of course, quite common to employ a so-called "freepoint-indicator tool" for determining that location. Typically, a cable-suspended freepoint indicator such as shown in U.S. Pat. No. 3,686,943 is lowered into the pipe string and successively stationed at one or more selected locations therein for determining whether elastic deformations can be induced in the corresponding incremental length of the pipe then lying between the upper and lower anchors of the tool as either torsional or tensional forces are applied to the surface end of the pipe string. Once it has been effectively established which sections of the pipe string are movable in response to such forces, the free portion of the pipe string is then severed or unthreaded from the remainder of the string and withdrawn from the well bore.

It will, of course, be appreciated that even when extreme forces are applied to the surface end of the string, only quite small deformations will be induced in a given incremental length of a pipe string straddled by the tool anchors at a given measurement station. Thus, it is quite important that both the upper and lower portions of the freepoint tool are always securely anchored against even limited slippage in relation to the pipe string.

Heretofore, as described in the aforementioned patent, the usual practice in conducting such freepoint operations is to simply apply either a longitudinal force or a rotational force to the upper end of a drill string; and, so long as any measurement is obtained at the surface indicating that a deformation is being induced in the drill string, operating a so-called "back-off shot" or a pipe-cutting device of some sort for separating the free upper portion of the drill string from its stuck lower portion. It will be recognized, of course, that under some circumstances a drill string may be capable of limited longitudinal movement but not be free for rotational movement but under other circumstances, be freely rotatable but securely lodged against significant longitudinal movement. However, although some prior-art freepoint tools such as the one shown in the aforementioned patent are responsive to both rotational and longitudinal movements of a drill string, it appears that no attempt has been made heretofore to measure such movements independently of each other.

Accordingly, it is an object of the present invention to provide new and improved methods and apparatus for obtaining accurate freepoint measurements representative of both longitudinal deformations and angular deformations which may be induced in a subsurface portion of a well bore pipe string upon application of either tensional or torsional forces to the surface end of the pipe string.

This and other objects of the present invention are attained by arranging a freepoint-indicator tool to include new and improved deformation-responsive sensor means supported between upper and lower tool-anchoring means which are selectively operable for moving their respective wall-engaging elements between extended and retracted operating positions. The sensor means include spaced portions respectively arranged to be preferentially responsive to longitudinal elongation and to angular deformation.

The novel features of the present invention are set forth with particularity in the appended claims. The invention, together with further objects and advantages thereof, may be best understood by way of the following description of exemplary methods and apparatus employing the principles of the invention as illustrated in the accompanying drawings, in which:

FIG. 3 is an exploded isometric view depicting a preferred arrangement of unique anchoring devices for the tool shown in FIG. 1;

FIG. 4 is a cross-sectional view taken along the lines '4—4' in FIG. 3; and FIG. 5 is an exploded isometric view of various elements of a preferred embodiment of a new and improved sensor unit of the present invention to be employed with the freepoint-indicator tool shown in FIG. 1.

Figure 1:
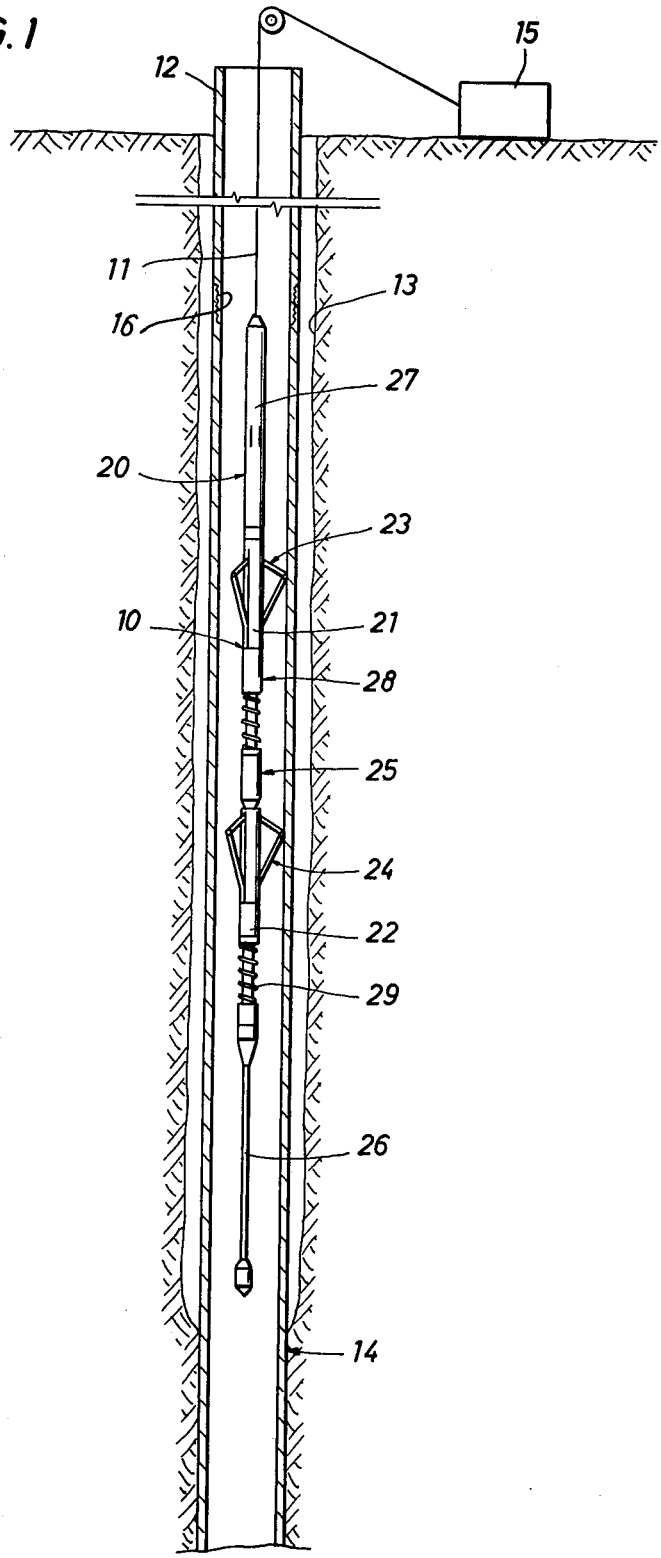
FIG. 1 illustrates a preferred embodiment of a freepoint-indicator tool having a new and improved sensor arranged in accordance with the principles of the present invention as the tool is being operated to perform the methods of this invention.

Turning now to FIG. 1, a freepoint-indicator tool 10 including new and improved sensor means 25 arranged in accordance with the principles of the present invention is illustrated as it may appear while it is suspended by a typical electrical logging cable 11 within a well bore pipe such as a string of drill pipe 12 positioned within a borehole 13 which has been drilled in the usual fashion by a floating or stationary drilling rig (not shown). As is all too common, the drill string 12 has previously become stuck, as at 14, in the borehole 13; and the tool 10 is now in position for obtaining one or more measurements from which the depth of the stuck point 14 can be determined. To control the tool 10 as well as to record various measurements as may be obtained during its operation, surface instrumentation 15 is cooperatively arranged for selectively supplying electrical power to the tool as well as for receiving measurement signals from the new and improved sensor 25 by way of the cable 11.

As generally depicted in FIG. 1, the freepoint-indicator tool 10 includes tool-anchoring means, such as a hydraulic-control system 27 coupled to longitudinally-separated upper and lower hydraulically-operated anchor units 28 and 29, and the deformation-sensing means 25 arranged in accordance with the principles of the present invention and cooperatively supported between the anchor units. The new and improved freepoint-indicator tool 10 is also arranged for dependently carrying any one of the several conventional explosive or chemical pipe-cutting devices or, as shown generally at 26, a so-called "explosive back-off tool." As is typical, the back-off tool 26 is comprised of an elongated tubular body carrying an electrical detonator and a sufficient length of explosive detonating cord for imposing a substantial explosive shock force against a coupling, as at 16, in the drill string 12 as is usually required to facilitate unthreading of the free portion of the drill string 12 from that coupling.

As will be later described in detail, the hydraulic-control system 27 is generally comprised of an elongated housing 30 carrying a motor-driven hydraulic pump 73 which is selectively operated as may be required for supplying pressured hydraulic fluid to the upper and lower anchor units 28 and 29. To isolate the pump 73 as well as to provide a reservoir from which the pump can withdraw hydraulic fluid, the housing 30 is divided into upper and lower isolated chambers which are communicated with one another, as by a central passage 51, for collectively defining a supply reservoir shown generally at 61. Mud ports 64 and a spring-biased piston 55 are cooperatively arranged in the housing 30 for maintaining fluids in the reservoir 61 at a pressure somewhat greater than the hydrostatic pressure in the borehole 13.

The hydraulic-control system 27 further includes a fluid outlet passage (as collectively provided by several interconnected passages 81, 86, 104, 185 and 190) which is coupled to the discharge side of the pump 73 for selectively communicating pressured hydraulic fluid to the upper and lower anchor units 28 and 29. To control the pressure in the fluid outlet passage, a solenoid-controlled valve member, as shown at 83, is arranged to selectively communicate the fluid outlet passage with the fluid reservoir 61 when pressure in the outlet passage is to be relieved. Similarly, as a safeguard, the hydraulic-control system 27 also preferably includes a normally-closed, spring-biased relief valve, as at 88, which automatically opens to communicate the fluid outlet passage with the reservoir 61 should the output pressure developed by the pump 73 exceed a predetermined operating pressure.

Figure 2C:
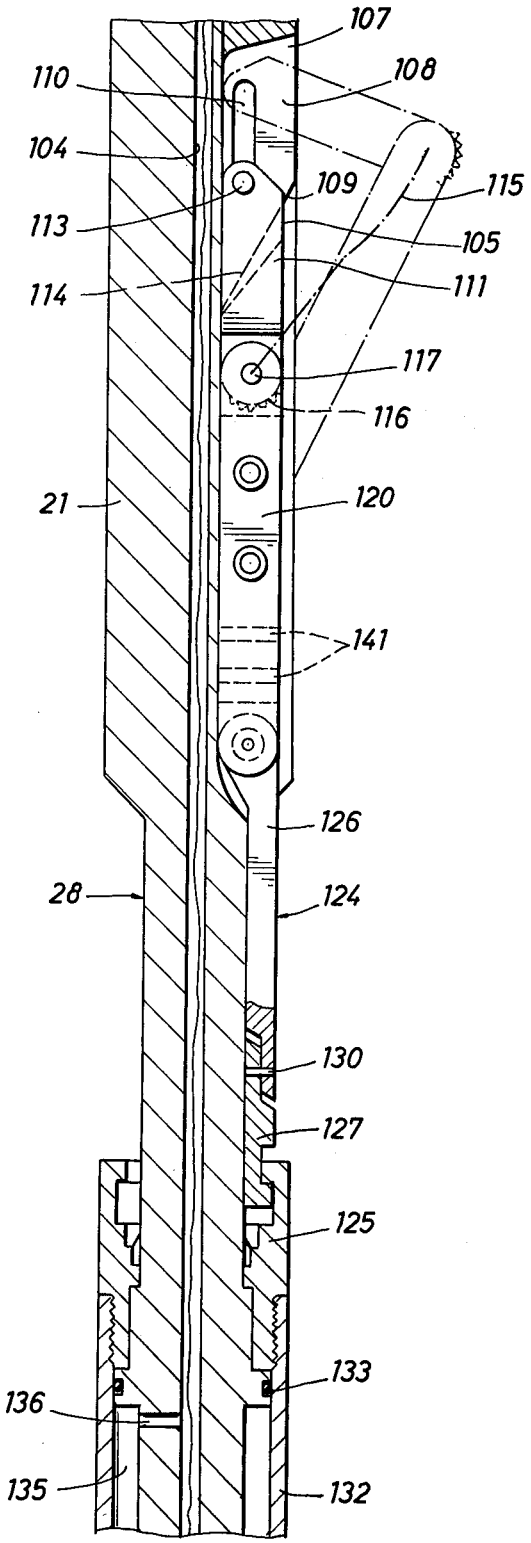
FIGS. 2A–2D are successive cross-sectional views of the upper portions of the freepoint indicator shown in FIG. 1.
Figure 2D:
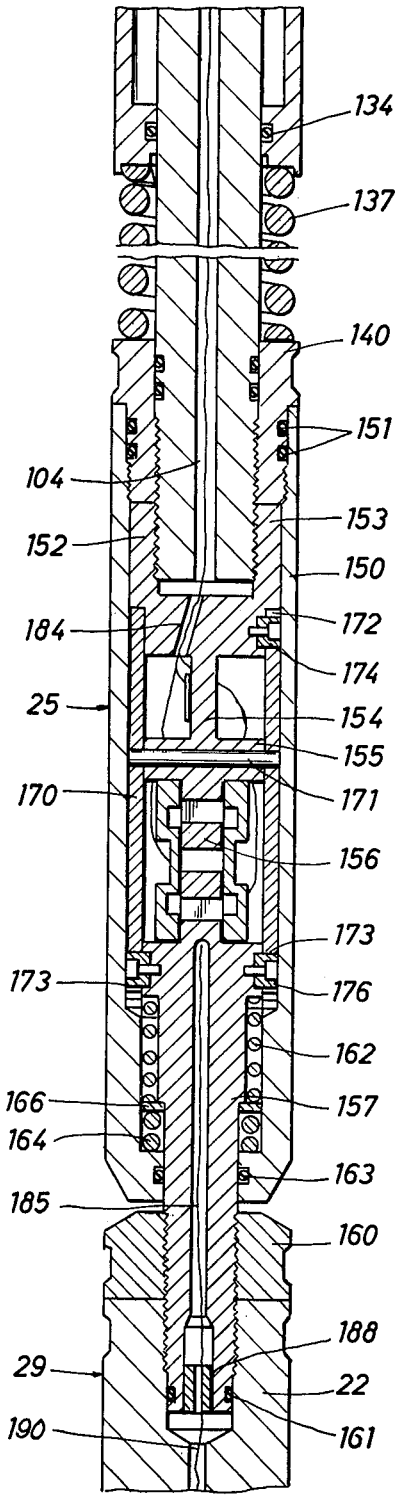
Figure 2A:
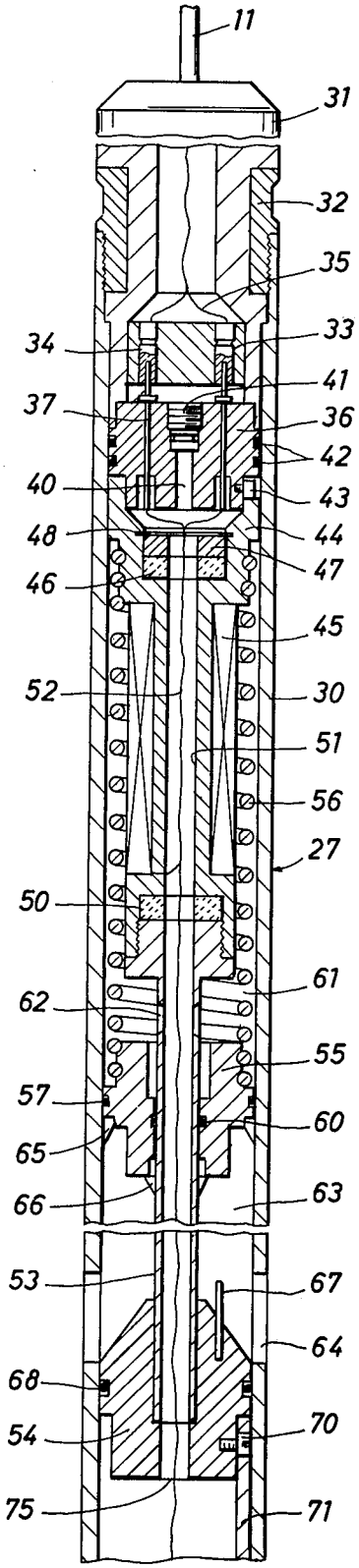
Figure 2B:
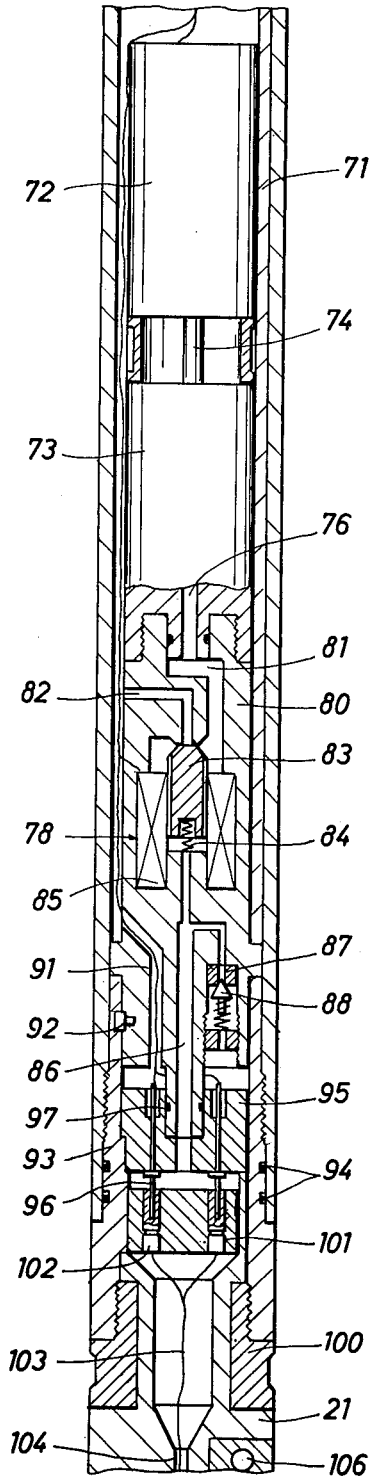

Referring now specifically to FIGS. 2A and 2B, in the preferred arrangement of the hydraulic-control system 27 illustrated there, the lower end of the cable 11 is fixed to a conventional head 31 dependently supporting the housing 30. The head 31 includes a bulkhead 36 sealingly arranged in the head and supporting various insulated connectors, as at 37, which are respectively connected to various electrical conductors, as at 35, arranged within the cable 11 for transmitting measurement signals and electrical power between the tool 10 and the surface instrumentation 15.

Although a separate collar locator can, of course, be coupled between the cable head 31 and the upper end of the housing 30, the freepoint-indicator tool 10 also includes a self-contained collar locator generally comprised of a centrally-positioned tubular mandrel 44 of a suitable ferromagnetic material carrying a coil 45 disposed between upper and lower permanent magnets 46 and 50. As is typical, therefore, when the coil 45 moves past a drill pipe joint, as at 16, the electrical signal appearing at the coil terminals is transmitted to the surface instrumentation 15 by way of the cable conductors 35.

A longitudinal passage 51 is arranged within the mandrel 44 for carrying conductors 52 connected to the connectors 37. The lower part of the mandrel 44 carries a coaxially-positioned tube 53 which, in the preferred embodiment of the control system 27, has its lower end fixed in a bulkhead 54 and defines an extension of the passage 51 for communicating the upper and lower portions of the supply reservoir 61 as well as for enclosing the conductors 52. The upper portion of the fluid reservoir 61 is communicated through one or more lateral openings 62 in the tube 53 with the passage 51 and the lower portion of the reservoir extending below the bulkhead 54. The piston 55 is slidably mounted around the tube 53 and biased upwardly as by a tension spring 56 mounted between the piston and the upper part of the coil mandrel 44. Outer and inner seals 57 and 60 are cooperatively arranged for fluidly sealing the piston 55 with respect to the housing 30 and the tube 53. The underside of the piston 55 and the space 63 inside the housing 30 and around the tube 53 is communicated with the fluids in the borehole 13 by way of openings 64 in the wall of the housing 30. The reservoir 61 is thereby maintained at a slight overpressure in relation to the hydrostatic pressure of the borehole 13 by a differential which is related to the upwardly-directed force imposed by the spring 56 on the piston 55. Since the space 63 below the piston 55 is ordinarily filled with drilling fluids from the borehole 13, the bottom of the piston is preferably equipped with scraper rings 65 and 66 respectively engaged with the housing 30 and the tube 53. A pin 67 mounted in the bulkhead 54 serves as a bottom stop for the piston 55.

As best seen in FIG. 2B, in the preferred arrangement of the hydraulic-control system 27, an elongated support 71 having an arcuate cross section is fixed, as by screws 70, to one side of the bulkhead 54 and carries the positive-displacement pump 73 which is operatively coupled by way of a drive shaft 74 to an electric motor 72 adapted to be operated upon application of power to the cable conductors 35. In operation, oil drawn from the reservoir 61 is delivered by the pump 73 through a fluid inlet passage 81 defined within a valve body 80 secured to the support 71 and, by means such as one or more longitudinal bypass grooves in a normally-closed valve member 83, communicated with an outlet passage 86 also defined within the valve body. To control the valve member 83, a spring 84 normally biases it to a position for closing a first bypass passage 82 in communication with the reservoir 61 and a solenoid actuator 85 is arranged in the valve body 80 for moving the valve member to an open position in which the passages 81 and 82 are communicated with one another. The outlet passage 86 is also selectively communicated to the reservoir 61 by way of a normally-closed, spring-biased valve member 88 adapted to open should the pressure in the outlet passage exceed a predetermined maximum pressure and communicate the outlet passage with a second bypass passage 91 in the valve body 80.

As will be further described in more detail, the hydraulically-operated anchor units 28 and 29 are cooperatively arranged to operate with sufficient speed that the freepoint-indicator tool 10 may be accurately positioned and set within the drill string 12 as the cable 11 is being lowered further into the borehole 13. In the preferred arrangement of the freepoint-indicator tool 10, the anchor units 28 and 29 are made at least substantially identical to one another. Each unit, as at 28, is provided with three wall-engaging anchor members, as at 111, which are pivotally mounted, as at 113, in a depending position at uniformly-spaced intervals around an enlarged upper portion of an elongated tool body 21 and respectively coupled (as by parallel pivoted links 120 and interconnected sliding members as at 126 and 127) to a common piston actuator 132 slidably arranged around a reduced-diameter intermediate portion of the tool body. To provide for rapid operation of the anchor unit 28, the actuating piston 132 is normally biased upwardly, as by a stout compression spring 137, toward one operating position where the anchor members 111 are fully extended. As will subsequently be explained, the piston actuator 132 is also cooperatively arranged so that, upon application of an increased hydraulic pressure, the piston will be moved downwardly along the tool body 21 to another operating position where the several anchor members 111 are retracted. Accordingly, it will be recognized that release of that increased pressure will allow the spring 137 to rapidly shift the anchor members 111 into anchoring engagement with the drill string 12 and with a force commensurate with the force provided by the spring.

Referring now specifically to FIGS. 2B, 2C and 2D, in the preferred arrangement of the upper hydraulically-operated anchor unit 28, the anchor body 21 is dependently coupled to the housing 30 as by a pair of threaded half-bushings 100. Electrical conductors 103 which are an extension of the connectors 52 are placed in the axial bore 104 of the body member 21 for interconnecting the cable conductors 35 with the deformation-sensing means 25 and the back-off tool 26.

To enable the freepoint-indicator tool 10 to operate within small-diameter pipe strings as well as to facilitate maintenance of the tool, three elongated vertical grooves, as at 105, are uniformly disposed around the enlarged upper portion of the tool body 21; and the upper portion of each groove is arranged for receiving an elongated mounting block 107 which is fixed to the tool body, as by a pin 106. The lower or depending portion 108 of each mounting block 107 is narrowed and shaped to define a narrow, outwardly-facing camming surface 109 inclined downwardly and inwardly toward the tool body 21. As best depicted in FIGS. 2C and 3, the upper end of each anchor member 111 is bifurcated thereby defining a vertical slot 112 for slidably receiving the depending lower portion 108 of its associated mounting block 107. To accommodate their respective upward and downward movements, the bifurcated portion of each anchor member 111 carries a transverse pin, as at 113, that is slidably disposed within an elongated vertical slot 110 arranged in the depending portion 108 of each mounting block 107. In a similar fashion, to initially direct the lower wall-engaging end of each anchor member 111 along an outwardly and upwardly-inclined path as shown generally at 115, the end surface of the vertical slot 112 in each anchor member is shaped, as at 114, to provide a downwardly and inwardly-inclined camming surface which is complementary to its associated camming surface as at 109.

As shown in FIGS. 2C and 3, the outer end of each anchor member 111 is pivotally coupled, as by a transverse pin 117, to the upper ends of the paralleled links 120. In turn, each of the links 120 are connected by way of a transverse pivot, as shown generally at 147, to tandemly-disposed upper and lower connecting members 126 and 127 which, in turn, are respectively joined to one another by a shear pin 130. The lower connecting member 127 has an outwardly-facing transverse groove 131 for receiving an inwardly-directed shoulder provided on the upper part of the actuator piston 132 which, in the preferred embodiment of the anchor unit 28, is arranged as a tubular member that is slidably mounted around the tool body 21. The upper end of the piston 132 is sealingly fitted on a seal 133 fixed around an outwardly-enlarged shoulder on the tool body 21 and the lower end of the piston is turned inwardly to define a reduced-diameter shoulder for carrying a seal 134 in sliding engagement with the tool body. In this manner, a piston chamber 135 is defined between the body member 21 and the piston 132 and communicated with the fluid passage 104 by way of transverse passage 136. To bias the piston 132 upwardly, the coil spring 137 is mounted in compression between the lower part of the piston and a collar 140 on the lower portion of the body 21.

It will be appreciated, therefore, that when the pump 73 is operated to develop an increased hydraulic pressure in the chamber 135, the piston 132 will be moved downwardly thereby compressing the spring 137 and carrying the several interconnecting members 120, 126 and 127 as well as the anchor members 111 to their respective positions as depicted in FIG. 2C. Conversely, whenever the solenoid valve 83 is operated to relieve the pressure in the chamber 135, the coil spring 137 cooperatively biases the piston 132 upwardly for simultaneously imposing a commensurate upwardly-directed force on each of the three sets of the links 120 by way of their respective interconnecting members 126 and 127. The lower ends of the anchoring members 111 will, therefore, then be moved outwardly away from the body 21, with this extension being relatively rapid inasmuch as the biasing force supplied by the spring 137 is selected to be of sufficient magnitude that, upon opening of the solenoid valve 83, the hydraulic fluid will be quickly expelled from the chamber 135 into the reservoir 61. Those skilled in the art will, of course, appreciate that although retraction of the anchors 111 may be relatively slow where the capacity of the pump 73 is limited in relation to the displacement volume of the chamber 135, the several fluid passages, as at 82, 86, 104 and 136, which are intercommunicated upon opening of the valve member 83 can be sized as required to assure rapid displacement of hydraulic fluid from the chamber to the reservoir 61.

As illustrated in FIG. 2C, the camming surfaces 109 and 114 as well as the elongated slot 110 are cooperatively arranged so that upward movement of the links 120 will be effective for shifting the outer ends of the anchoring members 111 outwardly and upwardly from the body member 21 along their respective paths 115. By suitably arranging the several elements associated with the anchoring members 111, these paths 115 will be upwardly inclined in relation to the longitudinal axis of the body 21 so that the radially-directed anchoring forces imposed on the several anchor members will remain substantially constant over a wide range of internal diameters of a drill string as at 12. This is, of course, of particular advantage in comparison to prior-art anchoring arrangements which generally are capable of developing only relatively small radially-directed anchoring forces in small-diameter pipes. By choosing, for example, the slope of the camming surfaces 109 and 114 such that the path 115 is at an angle of approximately 45° in relation to the longitudinal axis of the body 21 over a limited travel path of the pivot 117, the resulting radially-directed anchoring force will be substantially equal to the longitudinally-directed upward force supplied by the spring 137 since, over limited ranges of travel, the outward travel of the anchor end portions 116 will be substantially the same as the longitudinal distance traveled by the piston 132. It should also be noted that when the anchoring members 111 are engaged against the drill string 12, the weight of the tool 10 and any slack portion of the cable 11 will also be effective for imposing an additional anchoring force on the anchoring members 111. As illustrated, the lower ends 116 of the several anchors 111 are preferably serrated or sharpened to provide an improved gripping action against the wall of the drill string 12.

The uniquely-arranged anchoring units 28 and 29 are also preferably arranged for locking the lower ends of the paralleled links 120 against the body 21 whenever the anchoring members 111 are engaged with the internal wall of the drill string 12. As best seen in FIG. 3, the intermediate portions of the paralleled links 120 are cooperatively secured together, as by screws 123, and their lower portions slightly weakened, such as by one or more transverse grooves 141 in the opposite faces of the links, so as to promote limited sidewise or laterally-directed flexure of the lower portions of the links and thereby facilitate their limited movement outwardly into frictional contact with the adjacent sides of the longitudinal groove 105 as the anchors 111 are being extended. As illustrated, the lower ends 142 of the links 120 are cut away, as at 143, for complementally receiving the upper part of the connecting member 126. As shown also in FIG. 4, a tapered or hemispherical cavity 144 aligned along a lateral axis 'A–A' is formed in the inner face of each link end 142 and each recess is intersected by a cylindrical hole, as at 145, having its respective axis parallel to and displaced slightly upwardly in relation to the axis 'A–A'. As the links 120 are assembled, a transverse pivot or axle 147 having an enlarged or spherical mid-portion 146 is positioned in a complemental cylindrical passage in the upper end of the member 126 and the outer faces of the spherical mid-portion are respectively received in the inwardly-facing cavities 144 for pivotally intercoupling the links and the sliding member 126. It will be noted that by sizing the pivots 147 with a diameter somewhat smaller than their respectively-associated holes 145, the pivots are loosely received in those holes.

Accordingly, when the connecting member 126 is moved downwardly the pivots 147 will bear on the lower part of the cylindrical holes 145 as shown in FIG. 4 to carry the paralleled links 120 downwardly. The lateral clearances between the outer faces of the link ends 142 and the opposed sides of the longitudinal grooves 105 are then adequate for the several links 120 to move freely in relation to their respective mounting members 107. On the other hand, it will be appreciated from FIGS. 3 and 4 that as the sliding members 126 are moved upwardly within their respectively-associated grooves 105 on the mounting blocks 107, the relatively-loose fit of the pivots 147 within their respective mounting holes 145 will enable the upper ends of the interconnecting members to shift upwardly so as to respectively bring the upper portions of each of the balls 146 into engagement with their associated spherical cavities defined by the opposed hemispherical or tapered holes 144. These slight upward movements of the several balls 146 in relation to the several links 120 will, therefore, be effective for then wedging the slightly-flexed spaced end portions 142 of the paralleled link members laterally outwardly and into frictional contact against the adjacent side surfaces of the grooves 105. As a result, once the several anchor members 111 are engaged against the internal wall of the drill string 12, the wedging action of the lower ends 142 of the paralleled links 120 against the side walls of the grooves 105 will be effective for preventing significant side play of the link ends within the grooves. In this manner, whenever the upper and lower anchor units 28 and 29 are set in anchoring engagement within the drill string 12, the tool 10 will be firmly secured against downward movement as well as rotational movement or wobbling in relation to the drill string.

Turning now to FIG. 2D, the new and improved deformation-sensing means 25 of the present invention include a centrally-positioned mandrel 157 which is dependently secured, as by a coupling 153, to the upper anchor unit 28 and cooperatively arranged to dependently support the lower anchor unit 29 as the freepoint tool 10 is being positioned in the drill string 12. To protect the load-sensing unit 25 of the present invention, an elongated tubular housing 150 dependently suspended from the lower end of the upper anchor unit 28 is coaxially disposed around the mandrel 157 and fluidly sealed, as at 151 and 163, in relation thereto to define an annular fluid chamber which is communicated by a passage 184 with the fluid passage 104 in the tool body 21 thereabove. As is typical, a ball bushing 162 is coaxially mounted within the lower end of the housing 150 to frictionlessly center the lower portion of the mandrel 157 for free angular and axial movement in relation to the housing.

As best illustrated in FIG. 5, in the preferred embodiment of the new and improved load-sensor unit 25 of the present invention, the mandrel 157 is comprised of an upper portion 154 which is cooperatively shaped for preferential deflection in response to rotational or torsional loads on the mandrel and a lower portion 156 that is cooperatively shaped for preferential deflection in response to longitudinal or tensional loads imposed on the mandrel. Although the mandrel 157 can, of course, be differently arranged and still be within the scope of the present invention, it is preferred that the torsionally-responsive mandrel portion 154 be in the form of an elongated reduced-thickness bar extending between enlarged mandrel portions 152 and 155. Similarly, it is preferred that the tensionally-responsive mandrel portion 156 have a generally C-shaped mid-portion with the end of each of its horizontal legs being supported by a vertical portion extending from the immediately-adjacent portions of the mandrel. To protect this tensionally-responsive mid-portion 156, stiffening members, as at 180 and 181, are glued on either side of the mid-portion to increase its bending strength in the plane of the reduced-thickness upper mandrel portion 154.

To provide independent electrical signals which respectively are proportionally related to torsional and tensional loads acting on the new and improved load-sensing unit 25, a typical strain gage, as at 182, is fixed to one side of the upper mandrel portion 154 and a typical strain gage, as at 183, is fixed to the upright part of the C-shaped mid-portion 156. By connecting these strain gages 182 and 183 (by way of the conductors 52 and 103 as well as the cable conductors 35) to typical bridge circuits in the surface instrumentation 15, it will be recognized that the resulting separate electrical signals will be individually representative of any torsional and tensional loads imposed on the load-sensing unit 25.

It will, of course, be appreciated that the load-sensing unit 25 could well be damaged should extreme loads be imposed on the freepoint tool 10. Accordingly, in the preferred embodiment of the load-sensing unit 25 of the present invention, to limit deformational movements of the upper and lower mandrel portions 154 and 156, an elongated sleeve 170 is coaxially disposed around the mandrel 157 and firmly secured thereto as by a transversely-oriented pin 171 passing through the enlarged intermediate or mid-portion 155 of the mandrel. It will be noted, however, that the upper and lower ends of the sleeve 170 are not secured to the mandrel 157 so as to not restrict either rotational or longitudinal movements of the mandrel in relation to the outer housing 150. Accordingly, to define specified limits to the deformational movements of the mandrel 157 whenever a torsional force is applied to the load-sensing unit 25, a sectorially-shaped stop member 174 is mounted, as by a screw 175, on the upper enlarged mandrel portion 152 and projecting outwardly into an elongated circumferentially-aligned slot or window 172 formed in the adjacent wall portion of the sleeve 170. By arranging the length of the slot 172 to provide selected clearance gaps on either side of the stop 174, it will be recognized that the maximum extent of angular deformation which can be imposed on the load-sensor mandrel 157 can be closely defined. It should be noted in passing that the vertical height of the slot 172 is preferably arranged to allow only minor vertical clearance gaps between the upper and lower surfaces of the stop member 174. In this manner, extreme relative angular movements between the upper and lower anchor units 28 and 29 will cause the stop member 174 to engage one or the other ends of the slot 172. Once this occurs, the upper half of the sleeve 170 will carry the excessive load and thereby protect the reduced body portion 154.

A similar arrangement is employed for limiting the extent of axial deformation of the mandrel 157 under tensional loads. As illustrated, one or more sectorially-shaped stop members, as at 176, are screwed, as at 179, to a convenient location on the mandrel 157 and respectively disposed within corresponding elongated slots or windows, as at 173, in the load-limiting sleeve 170. In this instance, however, the windows 173 are designed with a vertical height sufficient to allow the stops 176 to move vertically over a predetermined span of deformation as may be expected for given tensional loads of a safe magnitude. On the other hand, the slots 173 are only slightly wider than the stops 176 to minimize any significant twisting of the lower end of the mandrel 157. Hereagain, extreme relative longitudinal movements between the upper and lower anchor units 28 and 29 will quickly cause the stop members 176 to shoulder out on the top or bottom edges of the slots 173 so that the lower half of the sleeve 170 will carry the excess load and thereby protect the reduced body portion 156.

It will, of course, be recognized that when the tool 10 is suspended in the drill string 12, the full weight of the lower anchor unit 29 as well as that of the back-off tool 26 will be dependently supported by the load-sensor mandrel 157. Accordingly, to relieve that load from the mandrel 157, it is preferred to cooperatively arrange a compression spring 164 between the lower end of the housing 150 and the mandrel for imposing an upwardly-directed force on the mandrel which is approximately equal to the combined weight of the units 26 and 29.

As previously mentioned, it is preferred that the lower anchor unit 29 be at least substantially identical to the upper anchor unit 28 as already described by reference to FIGS. 2C, 2D and 3. Accordingly the upper end of the elongated body 22 of the lower anchor unit 29 is cooperatively secured to the lower end of the load-sensor unit 29 is cooperatively secured to the lower end of the load-sensor mandrel 157. To provide fluid communication between the lower unit 29 and the hydraulic-control system 27, a longitudinal bore 190 (corresponding to the passage 104 shown in FIG. 2C) is arranged in the body 22 of the lower anchor unit. Since the upper and lower anchor units 28 and 29 are at least substantially identical to one another, no further description is necessary to understand the arrangement and operation of the lower unit.

In keeping with the objects of the present invention, in operating the freepoint tool 10 it is necessary that the upper anchor unit 28 be anchored within the drill string 12 before the lower unit 29. As previously mentioned, by setting the upper anchor unit 28 first, the cable 12 can be slacked-off and the weight of that cable portion supported by the upper anchor without imposing any extraneous load on the tool 10 which will affect the new and improved load-sensing unit 25 of the present invention. Accordingly, it is of particular significance to the present invention that to secure maximum efficiency of the new and improved load-sensing unit 25, sequential operation of the upper and lower anchor units 28 and 29 is assured by providing a fluid restriction, as at 188, in the hydraulic passage 185 of the mandrel 157 which communicates the hydraulic-control system 27 with the hydraulic passage 190 in the lower anchor unit. In this manner it is well assured that, upon opening of the solenoid valve member 83, the hydraulic fluid will be returned from the lower anchor unit to the reservoir 61 at a regulated reduced speed as established by the restrictor 199; and that actuation of the lower unit 29 will be measurably delayed until after the actuation of the upper limit 28.

It should also be noted that by virtue of the seal 163 (FIG. 2D), whenever there is a hydraulic pressure imposed on the upper and lower anchor units 28 and 29 for maintaining their respective anchoring elements, as at 111, in a retracted position, there is a downwardly-directed force acting within the housing 150 tending to elongate the sensor mandrel 157. However, since the freepoint tool 10 is cooperatively arranged to delay operation of the lower anchor 29, the depicted location of the fluid restrictor 188 will enable this unbalanced pressure force on the mandrel 157 to be at least substantially reduced before the lower anchor unit 29 is set.

Accordingly, whenever the freepoint-indicator tool 10 is being operated to locate the stuck point 14 of the drill string 12, the tool is lowered to a position where one or more measurements are to be made. It will, of course, be recognized that the collar-locating signals as provided by the coil 45 will enable the tool 10 to be moved to a given depth with a reasonable degree of accuracy. It will be further recognized that at some previous time power was applied to the motor 72 for operating the hydraulic-control system 27. Once a sufficient hydraulic pressure is developed, the anchor members 111 on the upper and lower anchor units 28 and 29 will remain retracted against the respective tool bodies 21 and 22 so long as the solenoid valve 83 remains closed. Then, as the freepoint tool 10 reaches a selected position within the drill string 12, power is applied from the surface instrumentation 15 by way of the cable conductors 35 to the solenoid actuator 85 as required for temporarily moving the valve member 83 to its open position. As described above, once the passages 86 and 104 are communicated with the fluid reservoir 61, the spring 137 will be effective for rapidly shifting the piston actuator 132 upwardly for quickly engaging the anchoring elements 111 of the upper anchor unit 28 within the drill string 12. As this occurs, the cable 11 is allowed to move further into the drill pipe 12 to allow a lower portion of the cable to slack off and come to rest on top of the now-anchored upper portion of the tool 10. Thus, it is quite certain that the cable 11 is not able to impose a tensional load on the tool 10 even when the measurement operation is being conducted from a floating platform that is being moved upwardly and downwardly by wave action. By virtue of the fluid restrictor 188, the setting of the lower anchor unit 29 is delayed so that the entire weight of the slacked-off portion of the cable 11 is fully supported by the upper anchor unit 28 and no extraneous compressional loads are imposed on the sensor mandrel 157.

Accordingly, once the upper and lower anchor units 28 and 29 are anchoringly engaged within the drill string 12, it will be appreciated that no unbalanced loads are imposed on the sensor mandrel 157 since the spring 164 was previously supporting the combined weight of the lower anchor unit and the back-off tool 30 until such time that the lower anchor was set. Thus, the deformation sensors 182 and 183 in the new and improved sensor unit 25 are fully responsive to whatever deformations can be produced in that intervening length of the drill string 12 which is then disposed between the upper and lower anchor units 28 and 29.

Since the technique for locating a given stuck point, as at 14, is typical, it is necessary only to point out that by virtue of the individual deformation sensors 182 and 183 and the assurance that no unbalanced loads were imposed on the sensor mandrel 157 in the new and improved sensor 25 before the tool 10 was set, it is quite reliable to assume that the measurement signals at the surface instrumentation 15 indicating either tensional or torsional deformation of the mandrel will always be directly related to a corresponding pull or torque which is then being applied to the surface end of the drill string 12. This assurance, therefore, has the unique advantage of allowing an operator to reliably determine whether torque can be applied from the surface to that specific length of the drill string 12 then being straddled by the engaged upper and lower anchor units 28 and 29. As a result, to further assure the unthreading of the drill string 12 at a given coupling, as at 16, the tool 10 is first set in position where the upper and lower anchors 28 and 29 either straddle or are just above the stuck point 14 and torque is then applied to the drill string. By monitoring the surface instrumentation 15, it can be reliably determined when a torque of a given magnitude is being developed in that portion of the drill string 12 immediately above the stuck point 14. This will, of course, enable the operator to impose a torque to the drill string 12 which will hopefully unthread the free portion of the drill string at the coupling 16. Once this measurement is obtained, if necessary the tool 10 can be released and, while torque is still maintained on the drill string 12, repositioned to locate the back-off tool 30 immediately adjacent to the coupling 16. Then, by applying power to the cable conductors 35, the back-off tool 30 can be detonated to impose a shock on the coupling 16 which will hopefully allow the still-applied torque to then unthread the drill string 12 at that coupling. A similar technique can also be employed with tension instead being applied to the drill string and an explosive or chemical pipe-cutting device is used.

Once a given freepoint measurement is obtained by means of the sensor 25 and the tool 10 is either to be repositioned or returned to the surface, it is necessary only to apply power to the cable conductors 35 to operate the pump 73 for returning the piston actuators, as at 132, on the upper and lower anchor units 28 and 29 to their respective lower operating positions. Once this is done and the upper and lower anchor elements 111 are retracted, the motor 72 can be halted and the developed hydraulic pressure will again be trapped within the hydraulic system 27 until such time that power is selectively applied to the solenoid actuator 85 from the surface instrumentation 15.

It should be noted that in the event some malfunction prevents downward travel of the actuating piston, as at 132, on either of the anchor units 28 and 29, the shear pins, as at 130, interconnecting the still-extended anchor members 111 to the actuating piston can be selectively broken by applying a predetermined tension to the cable 11. Once the appropriate shear pins 130 fail, their respectively associated sliding members 126 and links 120 are free to move downwardly so as to allow retraction of the extended anchor members 111.

Accordingly, it will be appreciated that by means of the present invention, new and improved methods and well bore apparatus have been provided for accurately locating the stuck point of a pipe string suspended in a well bore. In practicing the present invention, the unique freepoint-indicator tool described above is first moved to a selected position in a pipe string and the upper portion of the deformation-responsive sensor of the present invention is temporarily anchored to the adjacent wall surface of the pipe string. Then, after anchoring the upper sensor portion, the lower sensor portion is also temporarily anchored to a lower wall surface in the pipe string. Thereafter, rotational or axial loads are applied to the surface end of the pipe string and output signals produced by the new and improved deformation-responsive sensor of the present invention are monitored at the surface for determining whether such loads have induced a corresponding deformation in the intervening length of the pipe string extending between the spaced wall surfaces.

In the preferred arrangement of the new and improved freepoint-indicator tool as previously described, the new and improved deformation-responsive sensor of the present invention is tandemly supported between upper and lower anchor units respectively including outwardly-extendible wall-engaging elements which are arranged for selective movement between their extended and retracted positions. To assure the sequential operation of the anchoring units, control means are cooperatively arranged on the tool for delaying operation of the lower anchor unit until after the wall-engaging elements on the upper anchor unit are extended.

While only a particular embodiment of the present invention and one mode of practicing the invention have been shown and described, it is apparent that changes and modifications may be made without departing from this invention in its broader aspects; and, therefore, the aim in the appended claims is to cover all such changes and modifications as fall within the true spirit and scope of this invention.

What is claimed is:

1. A method for determining at least approximately a remote location at which a string of pipe may be stuck in a well bore and comprising:

moving a deformation-responsive sensor having first sensing means preferentially responsive to longitudinal deformations of a pipe string and second sensing means preferentially responsive to angular deformations of a pipe string to a selected depth location within said pipe string and anchoringly engaging the upper end of said sensor to an upper wall surface of said pipe string which is then adjacent to said upper sensor end;

thereafter anchoringly engaging the lower end of said sensor to a lower wall surface of said pipe string which is then adjacent to said lower sensor end; and thereafter, upon application of force to the surface end of said pipe string, simultaneously monitoring output signals from said first and second sensing means for detecting whether a corresponding longitudinal deformation and a corresponding angular deformation are then being induced in the incremental length of said pipe string between said upper and lower wall surfaces thereby demonstrating that said incremental length of said pipe string is at least partially situated above said remote location.

2. The method of claim 1 wherein each of the specified steps therein are successively repeated at other depth locations within said pipe string until at one of such other depth locations at least one output signal is obtained from said sensor indicating that no deformation is then being induced in that other incremental length of said pipe string then adjacent to said sensor thereby demonstrating that said other incremental length of said pipe string is below said remote location.

3. The method of claim 1 wherein said force being applied to the surface end of said pipe string is a tensional force.

4. The method of claim 1 wherein said force being applied to the surface end of said pipe string is a torsional force.

5. The method of claim 1 wherein a tensional force and a torsional force are being sequentially applied to the surface end of said pipe string.

6. Apparatus adapted to be suspended from an electrical cable and operated at different locations in a string of pipe to obtain measurements representative of deformations occurring therein in response to the application of forces to its upper end for determining at least the approximate location at which that string of pipe may be stuck in a well bore and comprising:

upper and lower anchoring means including upper and lower wall-engaging members adapted for respectively establishing anchoring engagement with the adjacent spatially-disposed wall surfaces of a pipe string;

control means cooperatively arranged and adapted for selectively operating said upper and lower anchoring means so that said upper wall-engaging members can establish anchoring engagement with the wall of a pipe string before said lower wall-engaging members can establish anchoring engagement therewith; and sensor means cooperatively arranged between said upper and lower anchoring means and adapted for independently producing first and second output signals which are respectively responsive to longitudinal and angular deformations occurring in an incremental length of a pipe string then situated between such spatially-disposed wall surfaces.

7. The apparatus of claim 6 wherein said sensor means include body means tandemly interconnecting said upper and lower anchoring means, said body means having a first portion thereof cooperatively arranged for preferential deflection in response to relative angular movement between said upper and lower anchoring means and a second portion thereof cooperatively arranged for preferential deflection in response to relative longitudinal movement between said upper and lower anchoring means, and first and second electrical means respectively arranged and adapted for producing characteristic first and second electrical signals upon deflection of said first and second body portions.

8. The apparatus of claim 7 further including first stop means cooperatively arranged on said sensor means for establishing a selected deflectional range of said first body portion to avoid damage thereto upon relative angular movements between said upper and lower anchoring means in excess of a predetermined magnitude, and second stop means cooperatively arranged on said sensor means for establishing a selected deflectional range of said second body portion to avoid damage thereto upon relative longitudinal movements between said upper and lower anchoring means in excess of a predetermined magnitude.

9. The apparatus of claim 7 further including biasing means cooperatively arranged between said body means and said upper anchoring means for supporting at least a portion of the weight of said lower anchoring means carried by said body means.

10. Apparatus adapted to be suspended from an electrical cable and operated at different locations in a string of pipe to obtain measurements representative of deformations occurring therein in response to the application of forces to its upper end for determining at least the approximate location at which that string of pipe may be stuck in a well bore and comprising:

tool-anchoring means including spatially-disposed upper and lower bodies, a plurality of wall-engaging anchor members movably mounted around each of said bodies and cooperatively arranged for movement between extended and retracted positions, and control means cooperatively arranged for selectively moving said anchor members on each of said bodies between their said extended and retracted positions so that said anchor members on said upper body can establish anchoring engagement with the wall of a pipe string before said anchor members on said lower body can establish anchoring engagement therewith; and sensor means cooperatively arranged between said upper and lower bodies and including an elongated intermediate body tandemly interconnecting said upper and lower bodies and having a first reduced-thickness portion adapted to be preferentially deformed in response to relative angular movements between said upper and lower bodies, and a second reduced-thickness portion adapted to be preferentially deformed in response to relative longitudinal movements between said upper and lower bodies, first electrical sensing means mounted on said first reduced-thickness body portion and adapted for producing first electrical signals representative of deformations thereof occuring upon relative angular movements between said upper and lower bodies, and second electrical sensing means mounted on said second reduced-thickness body portion and adapted for producing second electrical signals representative of deformations thereof occurring upon relative longitudinal movements between said upper and lower bodies.

11. The apparatus of claim 10 further including biasing means cooperatively arranged between said upper body and said intermediate body for imposing an upwardly-directed force thereon sufficient to offset at least a part of the weight of said lower body carried by said intermediate body.

12. The apparatus of claim 10 further including stop means arranged between said bodies for limiting deformation of said first reduced-thickness body portion to a predetermined maximum whenever relative angular movements between said upper and lower bodies exceed a predetermined first limit and for limiting deformation of said second reduced-thickness body portion to a predetermined maximum whenever relative longitudinal movements between said upper and lower bodies exceed a predetermined second limit.

* * * * *